US011986078B1

(12) United States Patent
Nelson

(10) Patent No.: US 11,986,078 B1
(45) Date of Patent: May 21, 2024

(54) COSMETICS APPLICATOR

(71) Applicant: Beau Nelson, Los Angeles, CA (US)

(72) Inventor: Beau Nelson, Los Angeles, CA (US)

( * ) Notice: Subject to any disclaimer, the term of this patent is extended or adjusted under 35 U.S.C. 154(b) by 263 days.

(21) Appl. No.: 16/740,235

(22) Filed: Jan. 10, 2020

Related U.S. Application Data

(60) Provisional application No. 62/790,518, filed on Jan. 10, 2019.

(51) Int. Cl.
*A45D 34/04* (2006.01)
*A45D 40/26* (2006.01)

(52) U.S. Cl.
CPC ..... *A45D 34/04* (2013.01); *A45D 40/26* (2013.01); *A45D 2200/1018* (2013.01)

(58) Field of Classification Search
CPC .. A47K 7/02; A45D 34/00; A45D 2200/1018; A45D 40/26–28; A45D 2200/10; A45D 34/04; A45D 33/00–36; A45D 2033/001
See application file for complete search history.

(56) References Cited

U.S. PATENT DOCUMENTS

D640,001 S * 6/2011 Limongi ..... A45D 34/04 D28/7
2009/0169286 A1* 7/2009 Herweijer ..... A45D 34/04 401/145
2018/0338600 A1* 11/2018 Dizes ..... B32B 7/02
2019/0059548 A1* 2/2019 Chaillet-Piquand ... A45D 33/34
2019/0159572 A1* 5/2019 Tarajano ..... A61M 35/003
2019/0274409 A1* 9/2019 Kolonne ..... A45D 34/04
2019/0289981 A1* 9/2019 Johnson ..... B29C 33/424
2020/0100579 A1* 4/2020 Torres ..... A45D 33/00
2020/0170379 A1* 6/2020 Bickford ..... A45D 44/00
2020/0187623 A1* 6/2020 Tammel ..... A45D 40/26
2020/0205552 A1* 7/2020 Shadduck ..... A45D 40/28
2021/0282533 A1* 9/2021 Tammel ..... A45D 33/34
2022/0240647 A1* 8/2022 Ballas ..... A45D 40/26

FOREIGN PATENT DOCUMENTS

WO WO-2007100252 A1 * 9/2007 ..... A45D 34/04

OTHER PUBLICATIONS

United States design U.S. Appl. No. 29/666,346, filed Oct. 11, 2018, Beau Nelson.

* cited by examiner

*Primary Examiner* — Cris L. Rodriguez
*Assistant Examiner* — Sydney J Pulvidente
(74) *Attorney, Agent, or Firm* — AdamsIP, LLC

(57) ABSTRACT

A cosmetics applicator and method of using the applicator are provided. The applicator has a body formed from a resilient material and is covered with a flexible, non-porous exterior coating that conforms to the shape of the body and is adhered to the material forming the body. The resilient body provides an applicator that is suitable for applying cosmetics to a user's skin, and the non-porous coating prevents cosmetics from being absorbed by the material forming the body.

14 Claims, 6 Drawing Sheets

COSMETICS APPLICATOR

CROSS REFERENCES

This application claims the benefit of U.S. Provisional Application No. 62/790,518, filed on Jan. 10, 2019, which application is incorporated herein by reference.

FIELD OF THE DISCLOSURE

The subject matter of the present disclosure refers generally to an applicator for applying cosmetics.

BACKGROUND

The term "cosmetics" generally refers to any substance that may be applied to a person's body in order to enhance or change the person's appearance. Cosmetics may include such substances as foundation, lipstick, mascara, eye shadow, eye liner, primer, concealer, blush, face powder, creams, lotions, nail polish, perfume, or various types of products for application to hair. Cosmetics may be applied using various types of applicators, such as brushes, sponges, pens, or a person's fingertips. Cosmetics intended to be applied to a person's face are generally referred to as "makeup." Makeup that is applied to the skin of the face is generally applied using brushes or makeup sponges, which are typically shaped like a disc or a wedge, though other shapes are sometimes utilized. Such types of makeup may include foundation, primer, concealer, blush, creams, or lotions.

Known makeup sponges used for applying makeup are typically made of a material that is compressible and generally resilient in that it quickly returns to its original shape and then retains that shape after being compressed. However, a disadvantage to known types of makeup sponges is that such sponges are also typically made of a porous material that absorbs makeup into the material when the sponge is used to apply the makeup. Over a period of time including multiple uses, makeup, which may include various types of makeup products, may become caked onto the surface of the sponge and absorbed deep into the pores of the sponge. When this occurs, the sponge must be thoroughly cleaned to remove any caked and/or absorbed makeup products, which may be difficult due to the porosity of the sponge and the consistency of one or more types of makeup products caked into the makeup sponge. Using a porous sponge that absorbs makeup often also causes cross-contamination between different types of makeup products when a user applies different types of makeup products using the same applicator, which is commonly done by many users. It may also cause a user to waste a certain amount of makeup that is absorbed into the makeup sponge.

Accordingly, there is a need in the art for an improved cosmetics applicator that overcomes the above disadvantages.

SUMMARY

A cosmetics applicator is provided. The applicator has a body that has a size, shape, and weight that is suitable for applying cosmetics to a user's skin. The body is formed from a material that is resiliently deformable, and the body is covered with a non-porous, flexible exterior coating that conforms to the shape of the body and is integrally formed with the material forming the body. In a preferred embodiment, the material forming the body comprises silicone foam and the exterior coating comprises a non-porous layer of silicone. The resilience of the material forming the body allows the body to deform upon the application of pressure and then naturally return to its original shape upon removal of the pressure. The resilience of the body provides an applicator that is soft to the touch and has a bounce that makes the applicator comfortable for a user to apply cosmetics to the user's face by direct contact with the applicator. The non-porous exterior coating that covers the body of the applicator forms a boundary between cosmetics being applied with the applicator and the material forming the body, which is preferably a porous material. The coating prevents the material forming the body from absorbing any cosmetics products being applied with the cosmetics applicator into the pores of the material of the body. This design minimizes cross-contamination between different types of makeup during normal use, reduces the amount of makeup wasted that is not applied to a user's skin, and also makes the present applicator easier to clean after use compared to both conventional brushes and sponges. The non-porous exterior coating preferably has at least one opening extending through the exterior coating to the porous material forming the body of the applicator.

In a preferred embodiment, the applicator has a rounded end section and an opposing tapered end section. The rounded end section is integrally formed with the tapered end section to form a continuous body so that the applicator is a single, distinct unit. The tapered end section has two opposing sides. The exterior coating on one side of the tapered end section preferably has a smooth exterior surface, and the exterior coating on the opposing side of the tapered end section preferably has a textured exterior surface. The tapered end section preferably has a pointed end. The two sides of the tapered end section provide different advantages in applying makeup using the applicator. The smooth side may be used to apply small amounts of makeup smoothly to a particular area of skin. The textured side may be used to remove some makeup if too much as been applied to a certain area of skin and then re-apply the excess makeup to another area. The textured side may also be used to blend and smooth areas of makeup to provide a consistent application over an area of skin. The tapered end section may be advantageous in accurately applying makeup to specific areas of the face that may be difficult to reach using an applicator with a broad surface area, such as areas of skin near the eyes or nose. The rounded end section may be used to hold the applicator while applying makeup using the tapered end section. The rounded end section may also be used itself to apply makeup to areas of skin that are easier to access with a broad surface area.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. As used herein, the term "created vector" and grammatical equivalents refers to the one or more vectors created by the processor based on the mapped activation levels of the one or more sensors.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
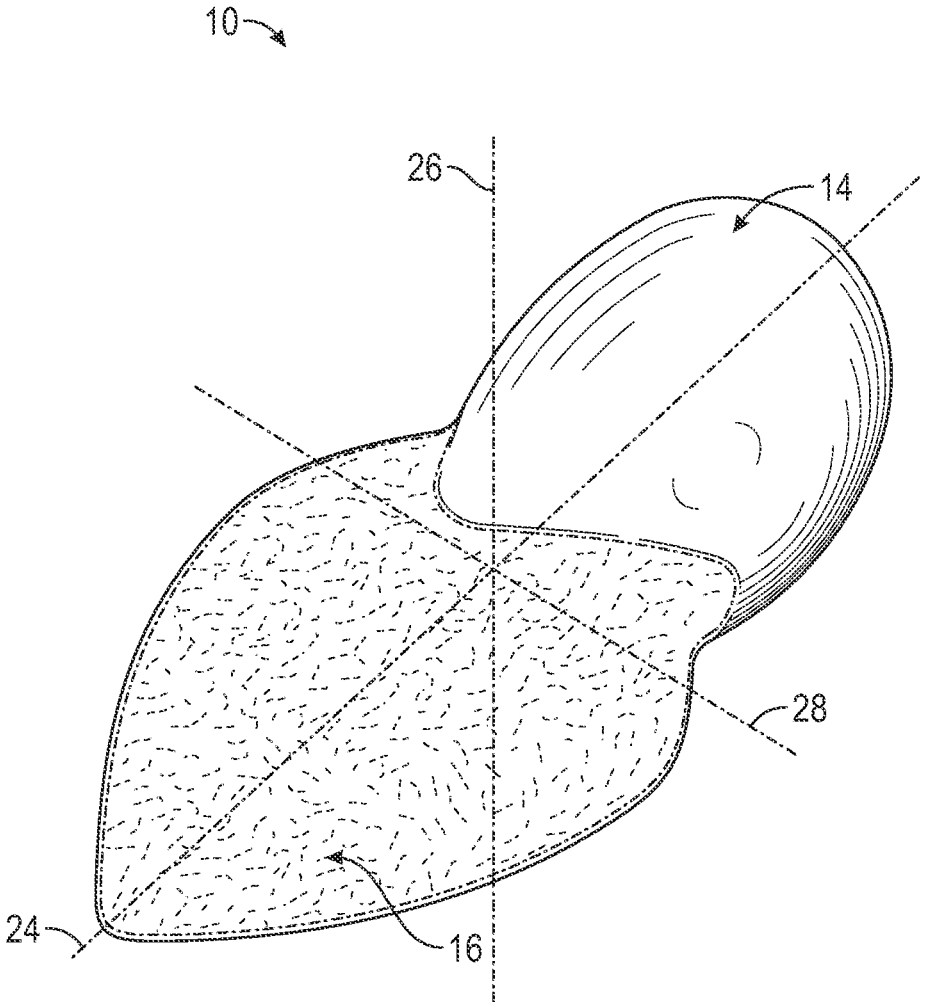
FIG. 1 shows a perspective view of a cosmetics applicator in accordance with the present disclosure.
Figure 3:
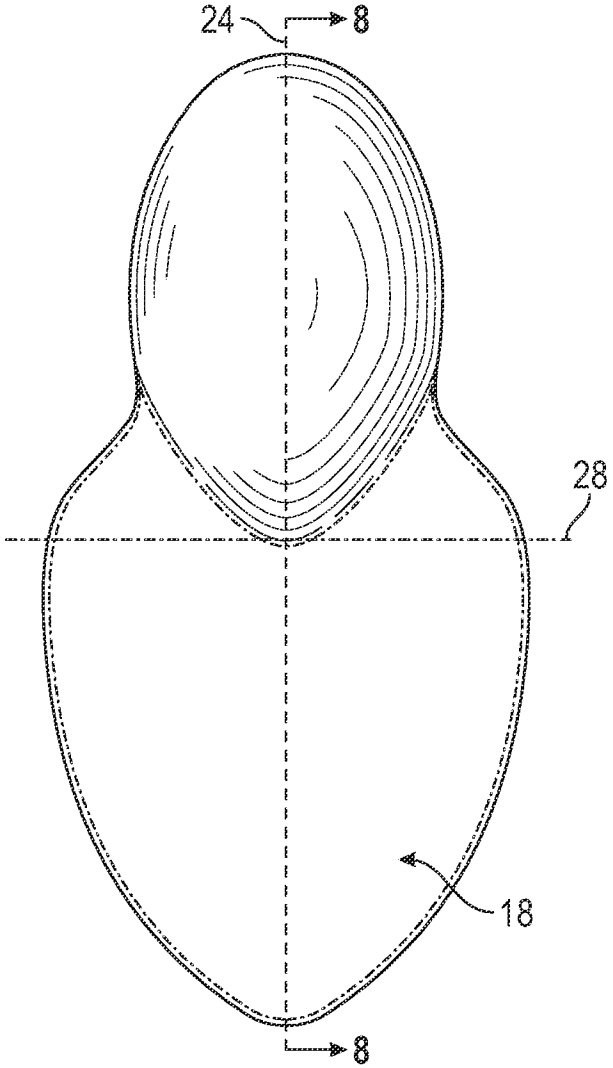
FIG. 3 shows a bottom plan view of a cosmetics applicator in accordance with the present disclosure.
Figure 6:
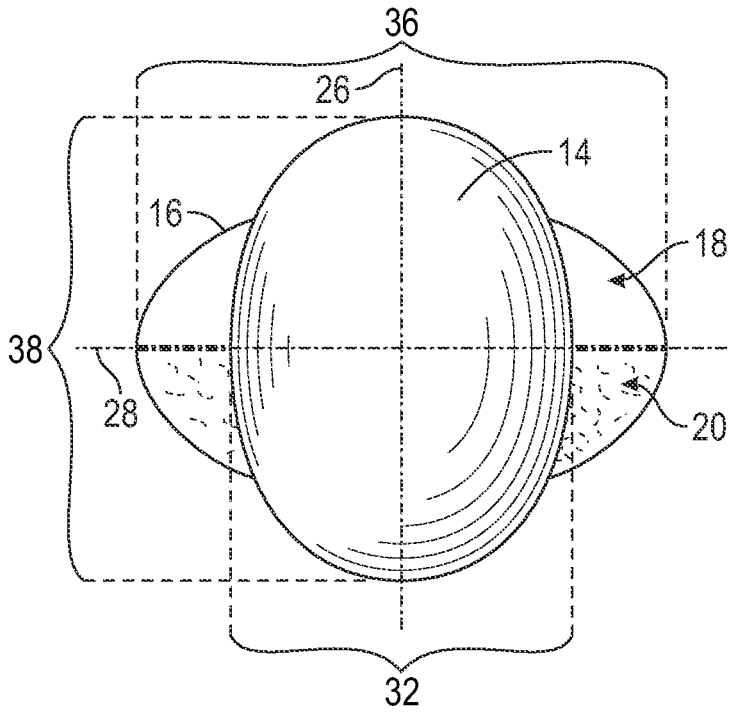
FIG. 6 shows a rear elevational view of a cosmetics applicator in accordance with the present disclosure.
Figure 7:
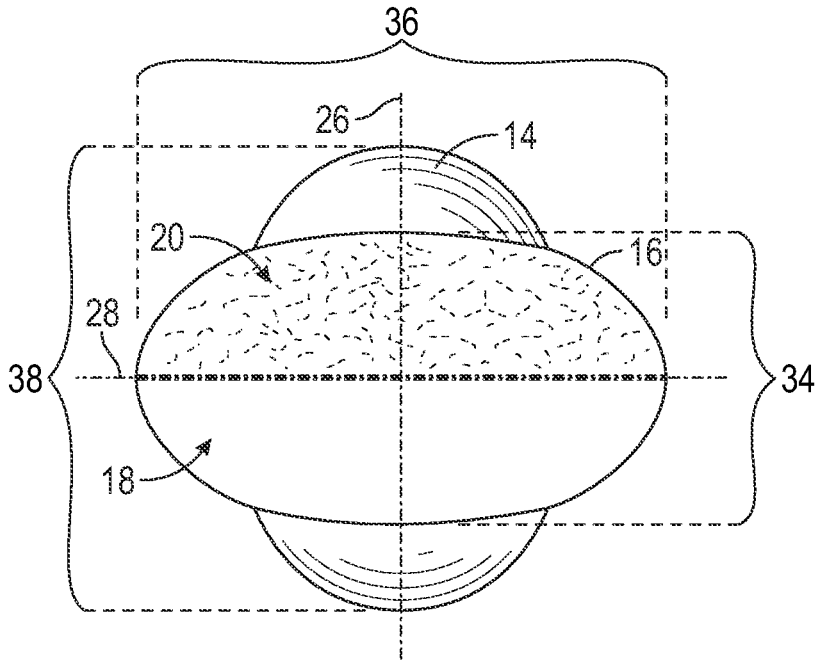
FIG. 7 shows a front elevational view of a cosmetics applicator in accordance with the present disclosure.
Figure 8:
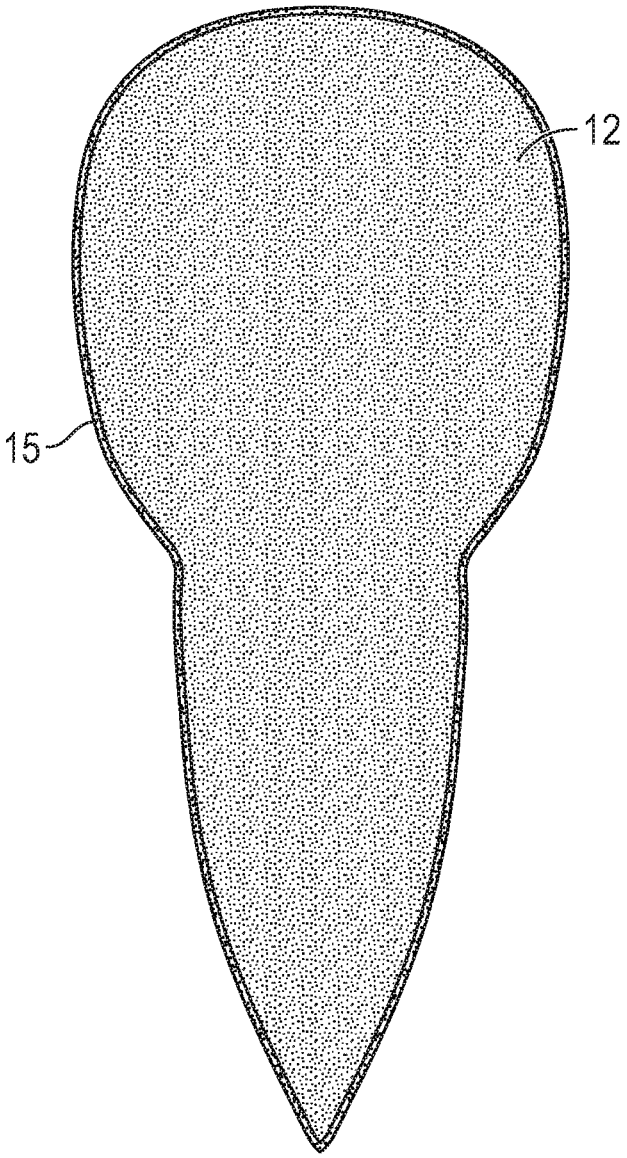
FIG. 8 shows a cross-sectional view of a cosmetics applicator in accordance with the present disclosure.

A cosmetics applicator 10 and a method of using the applicator are provided. FIGS. 1-10 illustrate preferred embodiments of the applicator 10. The applicator 10 is particularly advantageous when applying makeup, such as foundation or concealer, to areas of skin on a user's face. FIG. 1 shows a perspective view of the exterior of the applicator, and FIG. 8 shows a cross-sectional view of the applicator as shown in FIG. 3. The applicator 10 has a body 12 that has a size and a shape that is suitable for applying cosmetics to a user's skin. Thus, the body 12 has a size that is generally small enough for a user to hold in his or her hand using only one hand and is also extremely lightweight. The body 12 is also shaped to facilitate the application of makeup to the user's face. The body 12 is formed from a material that is resilient such that it can be easily compressed and deformed with the application of external pressure but will quickly return to its original shape when the pressure is removed. The material is preferably porous to facilitate resiliency. The resilience of the body provides an applicator that is soft to the touch and has a bounce that makes the applicator comfortable for a user to apply cosmetics to the user's face by direct contact between the applicator and the user's skin.

Figure 10:
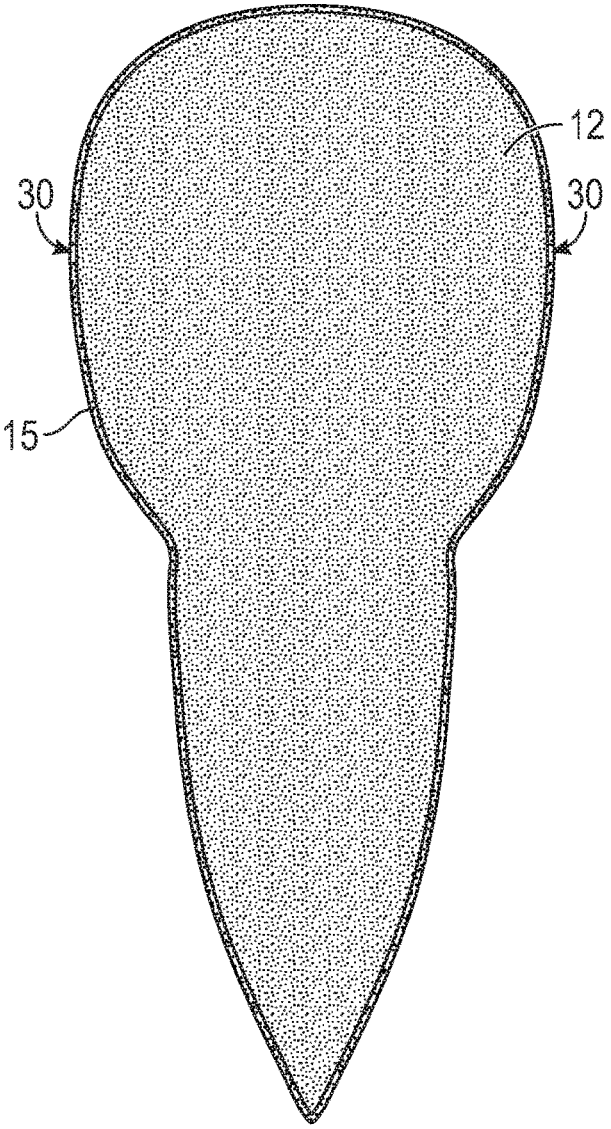
FIG. 10 shows a cross-sectional view of a cosmetics applicator in accordance with the present disclosure.

As shown in FIGS. 8 and 10, the body 12 of the applicator is covered with a non-porous, flexible exterior coating 15 that conforms to the shape of the body and is integrally formed with the material forming the body so that the combination of the body 12 and the coating 15 form a distinct unit. The exterior coating 15 is preferably made from a different type of material than the body 12 and is preferably adhered to the body 12 so that the coating 15 cannot be separated from the body 12. The non-porous exterior coating 15 that covers the body 12 of the applicator forms a boundary between cosmetics being applied with the applicator 10 and the material forming the body 12, which is internal to the exterior coating 15. The coating prevents the material forming the body from absorbing any of the cosmetics product disposed on the exterior surface of the coating for application to a user's skin. After use, the applicator may be cleaned quickly and easily of leftover makeup due to the non-porous coating, which makes the present applicator easier to clean compared to both conventional brushes and sponges. Thus, the present applicator does not allow any cosmetics product on the exterior surface of the applicator to be absorbed internally as typically occurs during normal use with conventional makeup sponges.

In a preferred embodiment, the material forming the body 12 may comprise a silicone foam, which may be produced from a mixture of silicone and a foam powder. The silicone utilized may be any suitable polyorganosiloxane compound, such as bispolyethylene dimethicone, for instance, or a similar compound. Preferably, the ratio of silicone to foam powder is generally about 100:1 to produce a silicone foam of suitable density and resilience. In alternative embodiments, the material forming the body may comprise any material or combination of materials that may form a body that is lightweight and that deforms easily due to pressure that may be applied by a user but that is resilient to such deformation so that the material quickly and easily returns to its original shape, thereby making the material suitable for use as a cosmetics applicator. Thus, the material forming the body may be made from a variety of different compressible types of foam, sponge, rubberized, or similarly deformable but resilient materials. The material forming the body is preferably porous to allow the body to be easily compressed. The body may preferably be produced by a molding process that defines its shape, and the material forming the body is thus preferably a material suitable for molding.

The exterior coating 15 may comprise a film, membrane, skin, sheath, laminate, or any other suitable layer of flexible, non-porous material. In a preferred embodiment, the coating 15 comprises silicone, which may include any suitable polyorganosiloxane compound capable of producing a flexible, pliable, non-porous coating. The material forming the coating 15, and preferably the body 12 as well, is preferably a non-toxic, food grade material because the exterior coating 15 will come into direct contact with a user's skin, including the user's face. In addition, the material forming the coating 15 is preferably generally acid and alkali-resistant and is generally soft with good tensile strength. The coating material is preferably also stable at a range of temperatures, including temperatures ranging from about −60° to 200° Fahrenheit. In alternative embodiments, the coating may comprise any suitable material, such as rubber or other types of polymers, that may form a non-porous layer and that is suitable for conforming to the shape of the body of the applicator and for adhering to the material forming the body so that the body 12 of the applicator and the exterior coating 15 may be integrally formed into a single unit.

Figure 9:
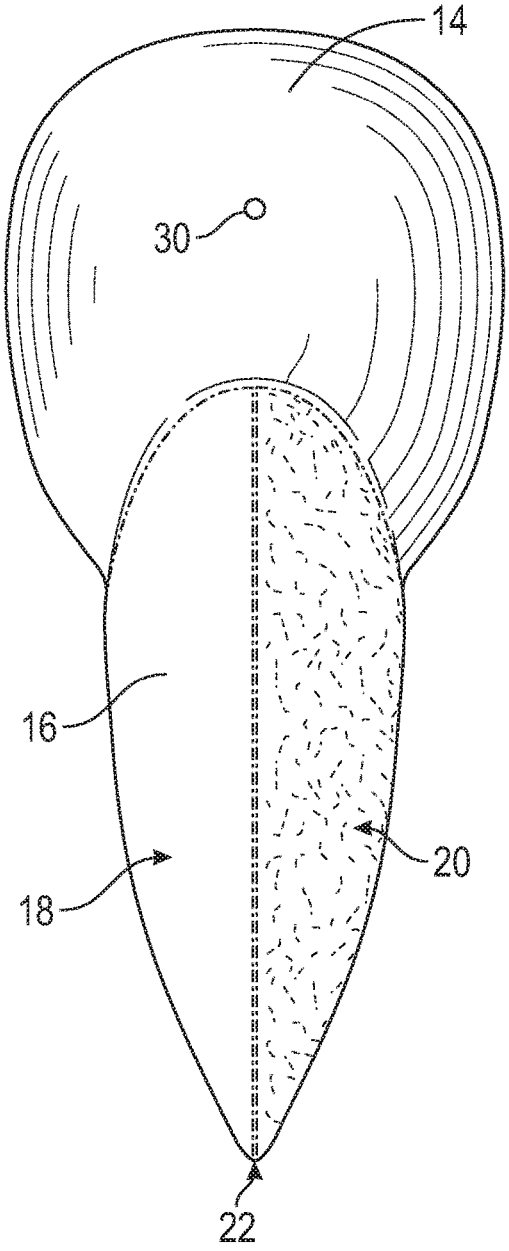
FIG. 9 shows a side elevational view of a cosmetics applicator in accordance with the present disclosure.

The exterior coating 15 preferably has at least one small opening 30 extending through the exterior coating 15 to the porous internal material forming the body 12 of the applicator 10. The one or more openings 30 may be positioned in select locations of the exterior coating 15 in order to allow air to move between the internal pores in the material forming the interior of the body 12 and the environment exterior to the applicator when the applicator is compressed or deformed and as the applicator returns to its original shape after being compressed or deformed. The openings 30 are preferably positioned at locations in the coating 15 that are not as likely to be used extensively for the application of makeup to minimize any amount of makeup product that may be absorbed into the internal pores of the interior of the body 12 through the openings 30. FIG. 9 illustrates one embodiment showing one preferable location of an opening 30 in the exterior coating 15. FIG. 10 illustrates a cross-section of an alternative embodiment having two opposing openings 30 in the exterior coating 15. The number of openings 30 and the size of the openings 30 are both preferably minimized to also minimize exposure of makeup products to internal pores through the openings 30.

The exterior surface of the coating 15 is used to apply cosmetics from the applicator onto a user's skin. Thus, the material used to produce the coating should be suitable for such use. For instance, the material should not be excessively sticky such that the coating does not stick to a user's skin and does not excessively limit the application of cosmetics from the exterior surface of the coating onto the user's skin.

Figure 2:
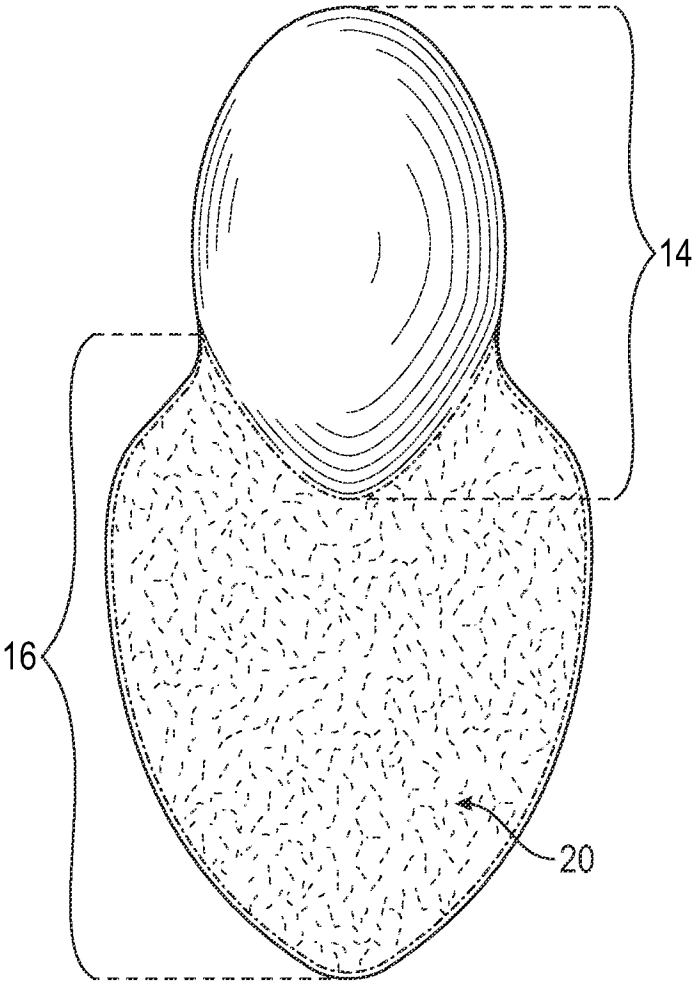
FIG. 2 shows a top plan view of a cosmetics applicator in accordance with the present disclosure.
Figure 4:
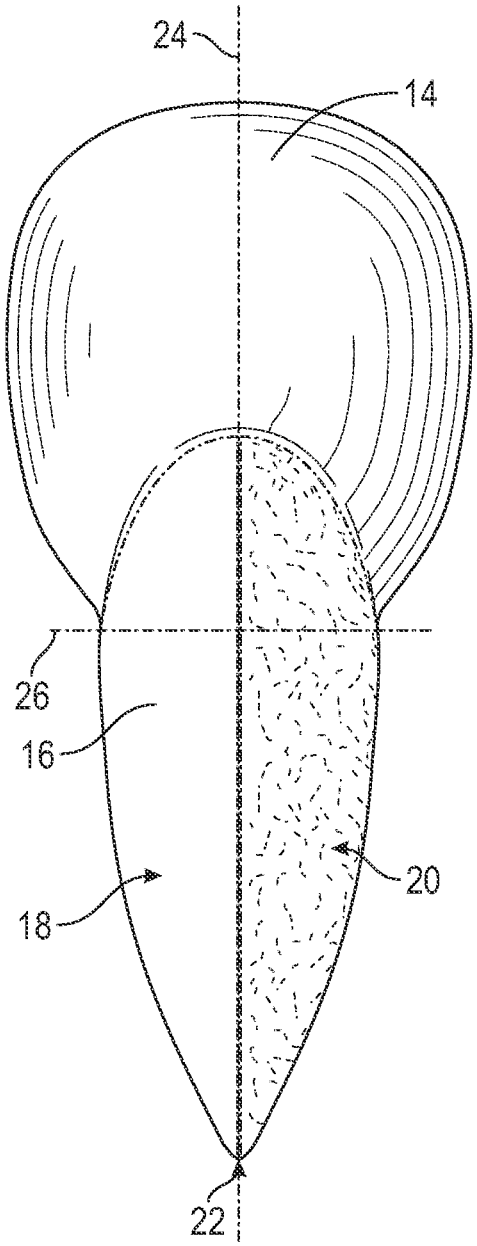
FIG. 4 shows a left side elevational view of a cosmetics applicator in accordance with the present disclosure.
Figure 5:
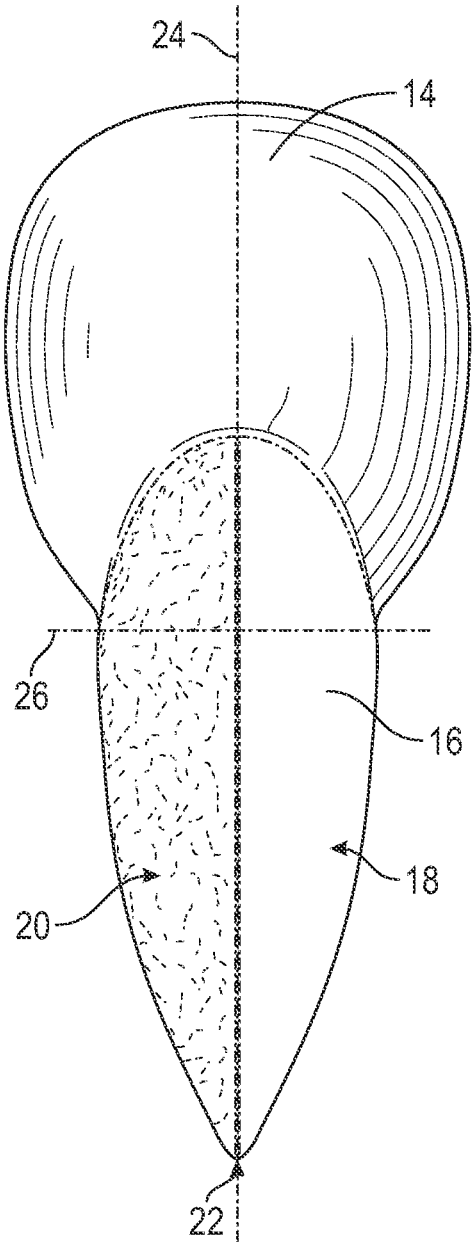
FIG. 5 shows a right side elevational view of a cosmetics applicator in accordance with the present disclosure.

In a preferred embodiment, as best illustrated in FIGS. 1 and 2, the applicator has a rounded end section 14 and an opposing tapered end section 16. As best illustrated in FIGS. 8 and 10, the rounded end section 14 is integrally formed with the tapered end section 16 to form a continuous body 12 so that the applicator 10 is a distinct unit. As best shown in FIGS. 4 and 5, the tapered end section has two opposing sides. In a preferred embodiment, the exterior coating 15 on one side has a smooth exterior surface 18, and the exterior coating 15 on the opposing side has a textured exterior surface 20. The two sides of the tapered end section may provide different advantages in applying makeup using the applicator. Either side may be used to contact cosmetics intended to be applied onto the skin, such as foundation, concealer, creams, or lotions. The user may then contact the tapered end section 16 of the applicator to the user's skin to apply the cosmetic. The smooth side 18 may be advantageous in applying small amounts of makeup smoothly to a particular area of skin. The textured side 20 may be used to remove some makeup if too much as been applied to a certain area of skin and then re-apply the excess makeup to another area. The textured side may also be used to blend and smooth areas of makeup to provide a consistent application over an area of skin. In addition, the textured side may be advantageous in applying makeup to textured skin, such as skin having prominent scars, pores, or divots, by more effectively pressing makeup into the textured surfaces of the skin.

As shown in FIG. 4, the tapered end section 16 preferably has a pointed end 22. The tapered end section 16, and particularly the pointed end 22, may be advantageous in accurately applying makeup to specific areas of the face that may be difficult to reach using an applicator with a broad surface area, such as areas of skin near the eyes or nose. The pointed end 22 of the applicator may be utilized to apply cosmetics in such areas. The rounded end section 14 may be used to hold the applicator 10 while applying makeup using the tapered end section 16. The rounded end section 14 may also be used itself to apply makeup to areas of skin that are easier to access with a broad surface area.

As best seen in FIG. 1, the applicator 10 has a longitudinal axis 24, a height axis 26, and a width axis 28, and each of the three axes is perpendicular to each of the other two axes. As best seen in FIGS. 1, 4, and 5, the rounded end section 14 and the tapered end section 16 are longitudinally aligned along the longitudinal axis 24. In a preferred embodiment, as best seen in FIGS. 6 and 7, the rounded end section 14 has a maximum height 38 that is greater than a maximum height 34 of the tapered end section 16, and the rounded end section 14 has a maximum width 32 that is less than a maximum width 36 of the tapered end section 16.

A method of using the applicator 10 is also provided. The method comprises providing a cosmetics applicator 10 and also providing an amount of at least one cosmetics product, such as foundation, concealer, or blush. The cosmetics applicator has a body 12 having a shape, wherein the body 12 is formed from a material that is porous and resilient, wherein the body 12 is covered with a flexible and non-porous exterior coating 15 that conforms to the shape of the body 12 and is integrally formed with the material forming the body 12. The method further comprises applying, by a user, the cosmetics product to an exterior surface of the exterior coating 15, such as the smooth exterior surface 18 or the textured exterior surface 20 of the tapered end section 16, of the applicator 10 and then using the exterior surface of the non-porous exterior coating 15 of the applicator 10 to apply the cosmetics product to an area of skin of the user. The pointed end 22 may also be utilized to apply the cosmetics product to an area of skin. The method may preferably further comprise the step of cleaning the cosmetics applicator 10 by removing the cosmetics product from the exterior surface of the non-porous exterior coating 15 after using the cosmetics applicator 10 to apply the cosmetics product to an area of skin. The exterior surface of the applicator 10 may be cleaned easily due to the non-porous exterior coating 15. Cleaning may be done by simply rinsing the applicator 10 with water or by using a mixture of mild soap and water.

The applicator 10 may be manufactured by any suitable method of producing an integrally formed body 12 formed from a resilient material and having a defined shape that is covered with a non-porous and flexible exterior coating 15 that conforms to the shape of the body 12 and is integrally formed with the material forming the body 12. The exterior coating 15 may be adhered to the material forming the body 12 of the applicator 10 after the body has been formed into its desired shape. In a preferred embodiment, the present applicator 10 may be manufactured through a molding process. First, a mold is provided having a shape conforming to the desired shape of the body 12 of the applicator 10, which preferably has a shape as is generally shown in FIGS. 1-10. A liquid silicone foam composition may then be added into the mold and allowed to cure to form the body 12 of the applicator 10. The liquid silicone foam composition may optionally be heated to accelerate curing. In alternative embodiments, the body of the applicator may have a different shape that is suitable for applying cosmetics to a user's skin. In addition, the size of the applicator may be varied so that individual users may select different sizes to suit personal preferences. It should be understood that the shape and size of the applicator may be varied and still fall within the scope of the present disclosure.

After molding the shape of the body 12 of the applicator, the exterior coating 15 is then applied to the exterior of the body 12 to finish production of the applicator 10. In a preferred embodiment, a liquid silicone may be applied to the exterior of the body 12 and allowed to dry and cure to form the non-porous exterior coating 15. A suitable curing agent may be utilized. The liquid silicone may optionally be sprayed onto the molded body 12, or the body may alternatively be submerged in a container of liquid silicone and then removed from the container to provide exterior coverage of liquid silicone over the body of the applicator to form the exterior coating 15 and adhere the exterior coating to the material forming the body 12 of the applicator. Heat may be applied as necessary during the application of liquid silicone to the body in order to accelerate curing and provide a stronger bond between the silicone coating 15 and the material forming the body 12 of the applicator so that the body and exterior coating are integrally formed as a single unit. If necessary, one or more additional applications of silicone coating may be applied to produce a layer of desired thickness and strength and to ensure that the coating 15 is uniform and sufficiently adhered to the body 12 to form the integrally formed applicator 10 unit. Once liquid silicone is applied to the body, the liquid silicone is allowed to dry and cure so that the coating 15 is adhered to the body 12 in order to form the finished applicator 10. To facilitate the application of liquid silicone to the body, the body 12 may optionally have a length of string (not shown) secured thereto. The string may be used to suspend the body for spraying liquid silicone onto the body, or may be used to lower the body into a container of liquid silicone and remove the body from the container. The string may optionally be removed after the manufacturing process is complete.

In an optional embodiment, the liquid silicone composition used to form the coating 15 may be applied to interior surfaces of a mold before adding the liquid foam composition into the mold to form an initial external layer of silicone as the body 12 of the applicator is molded. After curing, additional applications of liquid silicone may be applied to the exterior surface of the molded body, as described above.

It is understood that versions of the present disclosure may come in different forms and embodiments. Additionally, it is understood that one of skill in the art would appreciate these various forms and embodiments as falling within the scope of the invention as disclosed herein.

What is claimed is:

1. A method of using a cosmetics applicator, said method comprising the steps of:

providing a cosmetics applicator having an internal body, wherein the body has a shape comprising a rounded end section and an opposing tapered end section, wherein the rounded end section is integrally formed with the tapered end section, wherein the tapered end section has a pointed end, wherein the body is formed from a material that is porous and resiliently deformable, wherein the rounded end section and the tapered end section are covered with a flexible and non-porous exterior coating that conforms to the shape of the body and is integrally formed with the material forming the body, and wherein the body is entirely disposed internally to the exterior coating, wherein the exterior coating forms a non-porous boundary between the material forming the body and an exterior surface of the exterior coating, wherein the applicator has a longitudinal axis, a height axis, and a width axis, wherein the rounded end section and the tapered end section are longitudinally aligned along the longitudinal axis, wherein the height axis and the width axis are each perpendicular to each other and perpendicular to the longitudinal axis, wherein the rounded end section has a maximum height that is greater than a maximum height of the tapered end section, and the rounded end section has a maximum width that is less than a maximum width of the tapered end section, wherein the rounded end section has an exterior curved surface on a rear end opposite the tapered end section, wherein the rear end is defined entirely by an uninterrupted curvature of the exterior curved surface, wherein the exterior curved surface extends continuously between opposing sides of the rounded end section relative to the width axis, and wherein the exterior curved surface extends continuously between a top and opposing bottom of the rounded end section relative to the height axis;

providing a cosmetics product;

applying, by a user, the cosmetics product to an exterior surface of the exterior coating of the cosmetics applicator; and using the exterior surface of the non-porous exterior coating of the cosmetics applicator to apply the cosmetics product to an area of skin of the user.

2. The method of claim 1, wherein the non-porous exterior coating has at least one opening extending through the coating to the porous material forming the body.

3. The method of claim 1, further comprising the step of cleaning the cosmetics applicator by removing the cosmetics product from the exterior surface of the non-porous exterior coating after the step of using the cosmetics applicator to apply the cosmetics product to an area of skin.

4. The method of claim 1, wherein the tapered end section has two opposing sides, wherein the exterior coating on one side has a smooth exterior surface and the exterior coating on the opposing side has a textured exterior surface, wherein the step of using the cosmetics applicator to apply the cosmetics product to an area of skin comprises applying the cosmetics product using at least one of the smooth exterior surface and the textured exterior surface.

5. The method of claim 1, wherein the step of using the cosmetics applicator to apply the cosmetics product to an area of skin comprises applying the cosmetics product using the pointed end.

6. The method of claim 1, wherein the material forming the body comprises silicone foam.

7. The method of claim 1, wherein the non-porous coating comprises silicone.

8. A cosmetics applicator, wherein the applicator has an internal body having a shape comprising a rounded end section and an opposing tapered end section, wherein the rounded end section is integrally formed with the tapered end section, wherein the tapered end section has a pointed end, wherein the body is formed from a material that is porous and resiliently deformable, wherein the rounded end section and the tapered end section are covered with a flexible and non-porous exterior coating that conforms to the shape of the body and is integrally formed with the material forming the body, wherein the body is entirely disposed internally to the exterior coating, wherein the exterior coating forms a non-porous boundary between the material forming the body and an exterior surface of the exterior coating, wherein the applicator has a longitudinal axis, a height axis, and a width axis, wherein the rounded end section and the tapered end section are longitudinally aligned along the longitudinal axis, wherein the height axis and the width axis are each perpendicular to each other and perpendicular to the longitudinal axis, wherein the rounded end section has a maximum height that is greater than a maximum height of the tapered end section, and the rounded end section has a maximum width that is less than a maximum width of the tapered end section, and wherein the rounded end section has an exterior curved surface on a rear end opposite the tapered end section, wherein the rear end is defined entirely by an uninterrupted curvature of the exterior curved surface, wherein the exterior curved surface extends continuously between opposing sides of the rounded end section relative to the width axis, and wherein the exterior curved surface extends continuously between a top and opposing bottom of the rounded end section relative to the height axis.

9. The cosmetics applicator of claim 8, wherein the tapered end section has two opposing sides, wherein the exterior coating on one side has a smooth exterior surface and the exterior coating on the opposing side has a textured exterior surface.

10. The cosmetics applicator of claim 8, wherein the material forming the body comprises silicone foam.

11. The cosmetics applicator of claim 8, wherein the tapered end section has two opposing sides, wherein the exterior coating covers both of the two opposing sides of the tapered end section, wherein the exterior coating extends continuously around the rounded end section, and wherein the exterior coating extends continuously from the tapered end section to the rounded end section.

12. The cosmetics applicator of claim 8, wherein the tapered end section has a pointed end, wherein the tapered end section has two opposing sides relative to the height axis and two opposing sides relative to the width axis, wherein the two opposing sides relative to the height axis both taper toward the pointed end, and wherein the two opposing sides relative to the width axis both taper toward the pointed end.

13. The cosmetics applicator of claim 8, wherein the applicator is symmetrical along the longitudinal axis on opposing sides of a plane defined by the longitudinal axis and the height axis, and wherein the applicator is symmetrical along the longitudinal axis on opposing sides of a plane defined by the longitudinal axis and the width axis.

14. The cosmetics applicator of claim 8, wherein the uninterrupted curvature of the exterior curved surface that defines the rear end opposite the tapered end section is a curvature that extends 360 degrees from a most distal point of the rear end in a direction toward the tapered end section.

* * * * *